US005899546A

United States Patent [19]

Avendano et al.

[11] Patent Number: 5,899,546

[45] Date of Patent: May 4, 1999

[54] REFRIGERATOR CABINET AND METHOD OF ASSEMBLING THE SAME

[75] Inventors: Jose G. Avendano; Edward Everett Crompton, III; Richard James Miller; John Phillip Myers; John C. Rue, Sr., all of Galesburg; Robert A. Christenson, Wataga; Sheldon W. Mandel; Michael A. Mohrfeld, both of East Galesburg; Robert M. Riley; Scott Robert Voll, both of Galesburg, all of Ill.

[73] Assignee: Maytag Corporation, Newton, Iowa

[21] Appl. No.: 08/869,428

[22] Filed: Jun. 4, 1997

[51] Int. Cl.[6] ..... A47B 96/04

[52] U.S. Cl. ..... 312/406.2; 312/406

[58] Field of Search ..... 312/236, 257.1, 312/400, 401, 406, 406.2, 263

[56] References Cited

U.S. PATENT DOCUMENTS

| | | | |
|---|---|---|---|
| 4,558,503 | 12/1985 | Wilson . | |
| 4,580,852 | 4/1986 | Smitte et al. | 312/406.2 |
| 4,586,348 | 5/1986 | Nakayama et al. | 312/406.2 X |
| 4,632,470 | 12/1986 | Jenkins et al. . | |
| 4,735,062 | 4/1988 | Woolley et al. | 312/406.2 X |
| 4,822,117 | 4/1989 | Boston, Jr. . | |
| 4,958,890 | 9/1990 | Anderson et al. . | |
| 4,974,914 | 12/1990 | Jenkins | 312/406.2 |
| 5,368,381 | 11/1994 | Mandel | 312/406.2 |

FOREIGN PATENT DOCUMENTS

| | | | |
|---|---|---|---|
| 100320 | 1/1962 | Netherlands | 312/406.2 |
| 360527 | 1/1973 | U.S.S.R. | 312/406.2 |

*Primary Examiner*—Peter M. Cuomo
*Assistant Examiner*—James O. Hansen
*Attorney, Agent, or Firm*—Everett G. Diederiks, Jr.

[57] ABSTRACT

A refrigerator cabinet assembly includes a shell formed by opposed, upright side walls and a top wall, all of which have in-turned front and rear face portions with each of the front face portions terminating in a return flange defining a liner receiving cavity opening forwardly of the shell. Each liner receiving cavity is spaced inwardly of a respective side and top wall such that a channel, which is readily accessible from within the shell, is defined. A rear wall is interconnected to the side and top walls by being arranged between and forced to intimately contact a pair of spaced layers defining the rear face portions of each of these walls. A plurality of reinforcement members, including a pair of upper corner plates and a pair of side reinforcement bars adapted to be arranged in the channel, as well as upper and lower crossbars in one preferred embodiment that interconnect the side reinforcement members, are attached to the shell, along with a mullion plate and a faceplate. Since the return flanges open forwardly of the shell, a liner can be front loaded therein in a quick and easy fashion with an inwardly extending flange provided on the liner projecting into the liner receiving cavity. The side reinforcement members and their associated brackets are provided with structure defining hinge locations for both refrigerator door hinges, as well as one hinge for a freezer compartment, to assure proper alignment and spacing of the hinges.

21 Claims, 14 Drawing Sheets

-200-

REFRIGERATOR CABINET AND METHOD OF ASSEMBLING THE SAME

BACKGROUND OF THE INVENTION

1. Field of the Invention

The present invention pertains to the art of refrigerators and, more particularly, to the structure of and reinforcement for the shell of a refrigerator cabinet.

2. Discussion of the Prior Art

In constructing a refrigerator cabinet, it is highly desirable to minimize the weight of the cabinet shell to reduce manufacturing, transportation and additional associated costs, yet it is imperative that the cabinet be structurally sound in order to counteract loads exerted thereon without deforming. Mainly due to cost efficiencies and flexibility in workmanship, it has been commonplace to utilize sheet metal in the forming of most refrigerator cabinets on the market today. Since the sheet metal is thin and rather high loads tend to be concentrated on the shell, particularly by the opening and closing of a weighted down refrigerator door, a fair amount of effort has been applied in this art to provide reinforcement for such a refrigerator cabinet shell. Of course, an additional important concern is also the ease of assembly of the cabinet as a whole.

With this in mind, it has heretofore been proposed to form the sides and top of a refrigerator cabinet shell out of a single piece of bent sheet metal and then to attach thereto rear and bottom walls. An example of such a known arrangement is illustrated in FIG. 1 at 2 with the side walls 4 and 6 being integrally formed with top wall 8, while rear wall 10 and bottom wall 12 are attached thereto. The front edge portions of the side and top walls are in-turned to defined front face portions 16 of the cabinet and these front face portions 16 are additionally bent to form return flanges 20 (also see FIG. 2) which define a liner receiving cavity 22 that opens laterally inwardly of the shell 2.

With this arrangement, side reinforcing bars 24 and 25 can be slid between the front face portions 16 and the return flange 20 on either side of the cabinet for reinforcement purposes. A flexible liner 30 can then be positioned within the shell 2 by causing the liner 30 to bow inward in order that an outwardly projecting annular flange 32 of the liner 30 can be received within the liner receiving cavity 22. A similar freezer liner (not shown) can likewise be inserted. A mullion support bar assembly 34 is also positioned within a section of the liner receiving cavity 22 and threaded fasteners 36 are used to secure the side reinforcing bars 24 and 25, as well as the support bar assembly 34 and the liner 30, to the front face portions 16 of the shell 2. In addition to the attaching of a cross plate 40, a foam 42 is injected between the shell 2 and the liner 30 which forms an insulation barrier and also adds to the overall structural rigidity of the cabinet.

The major drawbacks of such a known arrangement is the difficulties associated with assembling the cabinet including the manner of insertion and the aligning of the various reinforcement members, as well as the associated design considerations of the liner itself to enable the same to adequately flex for insertion into the flange of the cabinet while not being damaged.

There has also been proposed in the art to provide a cabinet shell design which will directly receive a liner without the need to flex the liner into place. Such an arrangement is commonly referred to as "front loading" of the liner. FIG. 3 illustrates one typical known design of this type wherein liner 44 can be directly inserted into cabinet shell 46 with flange 48 of liner 44 simply abutting a laterally extending portion of the cabinet shell 46. Again the space between the liner 44 and the shell 46 is foamed with insulation. Such a cabinet design obviously enhances the assembly of the liner to the shell. Unfortunately, many of the advantageous features of prior designs are lost with such a front loading arrangement. These features include larger design tolerances, enhanced liner stability following installation and desirable aesthetic qualities to name a few.

Therefore, there exists a need in the art of refrigerators for a cabinet assembly having enhanced structural and simplified assembly characteristics, while also being cost effective and aesthetically pleasing.

SUMMARY OF THE INVENTION

The cabinet assembly of the invention includes a shell that is formed by opposed, upright side walls which are spaced and interconnected by a top wall. The side and top walls are in-turned at their respective fore and aft edge portions so as to define front and rear face portions. A rear wall is interconnected to the side and top walls by being arranged between and forced to intimately contact a pair of spaced layers defining the rear face portions of each of these walls. The front face portions terminate in return flanges, each of which defines a section of a liner receiving cavity that opens forwardly of the shell. Each liner receiving cavity section is also spaced inwardly of a respective side and top wall such that a channel, readily accessible from within the shell, is defined.

The cabinet assembly further includes a plurality of reinforcement members for the shell. These reinforcement members include a pair of upper corner plates which are secured within the channel at respective interconnection locations of the top and side walls, a pair of side reinforcement bars each of which carries upper and lower support brackets and is positioned in the channel behind a front face portion of a respective side wall, and, at least in one preferred embodiment particularly adapted for use in larger, heavy duty refrigerators (e.g. refrigerators of approximately 20 cubic feet or greater), upper and lower crossbars extending between the upper and lower support brackets respectively. A mullion plate is also positioned between the upper support brackets and a kickplate is attached in front of the lower support brackets.

With this construction, a reinforced refrigerator cabinet can be efficiently assembled with the channel being readily accessible for insertion of the upper corner plates and the side reinforcement bars due to the structure and configuration of the return flanges. In the preferred embodiment, the reinforcement members are preferably adhesively joined with induction curing, projection welded and/or pierce riveted in place. In is further preferable to initially adhesively attach at least the upper corner plates in position prior to welding thereof to further ease the assembly process. Since the return flanges open forwardly of the shell, a liner can be front loaded therein in a quick and easy fashion with an inwardly extending flange provided on the liner projecting into the liner receiving cavity. The side reinforcement bars and their associated brackets are provided with structure defining hinge locations for both hinges of a lower door, as well as one lower hinge for an upper door in a refrigerator having refrigerator and freezer compartments located one above the other. This arrangement assures proper alignment of the hinges. Once the reinforced shell is constructed as discussed above with the addition of a bottom wall, an insulation foam can be injected between the shell and the liner(s) to further strengthen the assembly and interconnect the various parts.

Further features and advantages of the refrigerator cabinet and the method of assembling the same in accordance with the invention will become more readily apparent from the following detailed description of preferred embodiments thereof when taken in conjunction with the drawings wherein like reference numerals refer to corresponding parts in the several views.

DETAILED DESCRIPTION OF THE PREFERRED EMBODIMENT

Figure 1:
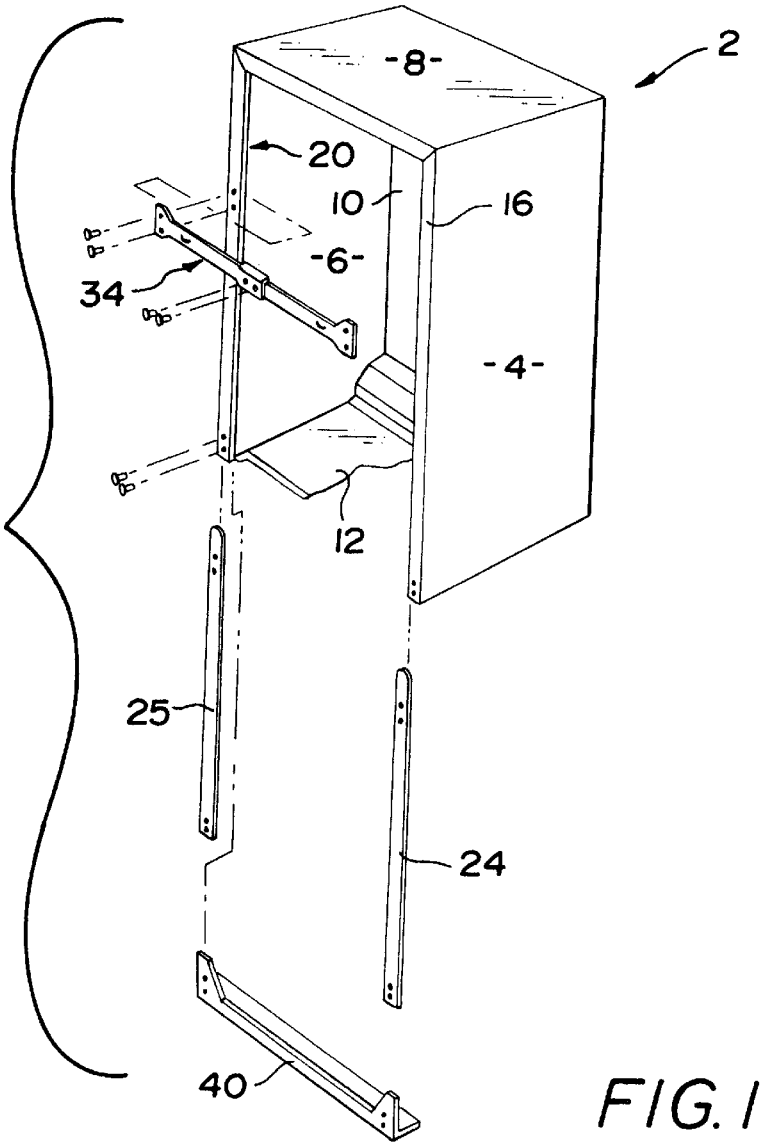
FIG. 1 (PRIOR ART)
FIG. 1 is an exploded view of a reinforced refrigerator cabinet assembly constructed in accordance with the prior art.
Figure 2:
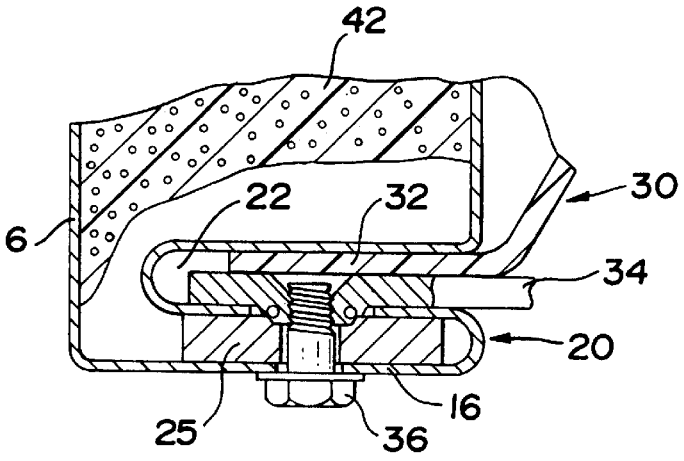
FIG. 2 (PRIOR ART)
FIG. 2 is a cross-sectional view of a front side corner of the cabinet of FIG. 1 with a liner connected thereto.
Figure 3:
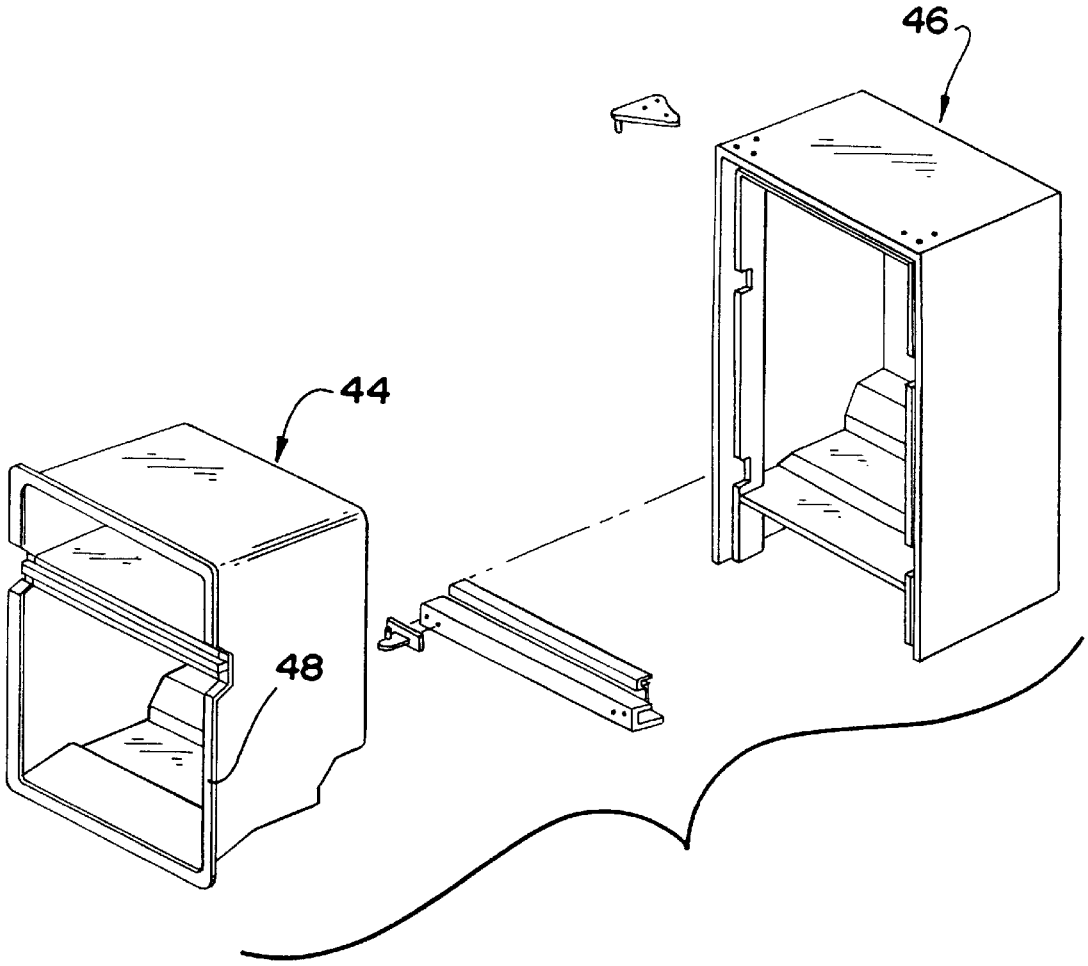
FIG. 3 (PRIOR ART)
FIG. 3 is an exploded view of another cabinet assembly constructed in accordance with the prior art.
Figure 4:
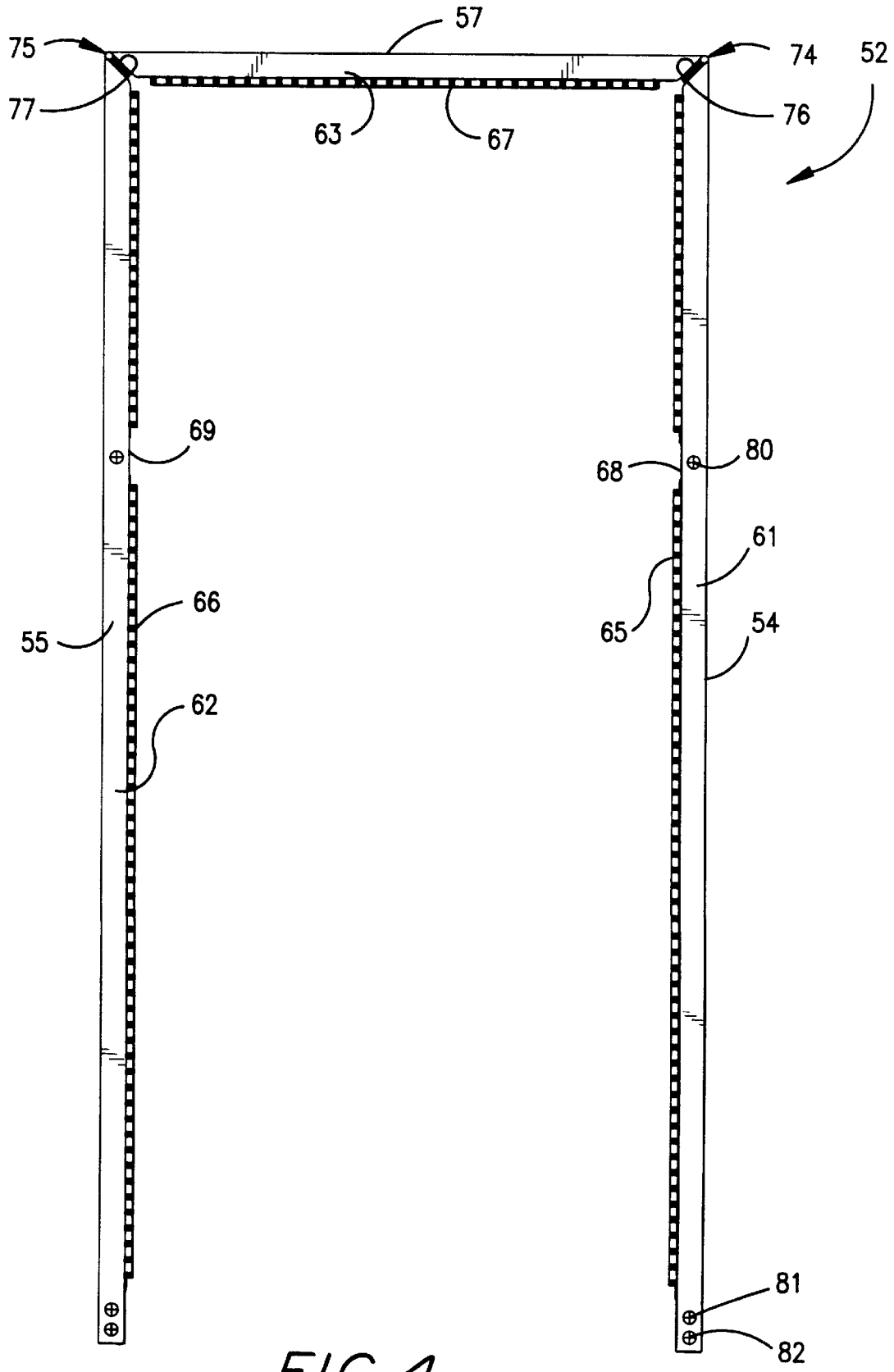
FIG. 4 is a front view of a shell of the refrigerator cabinet of the invention.
Figure 5:
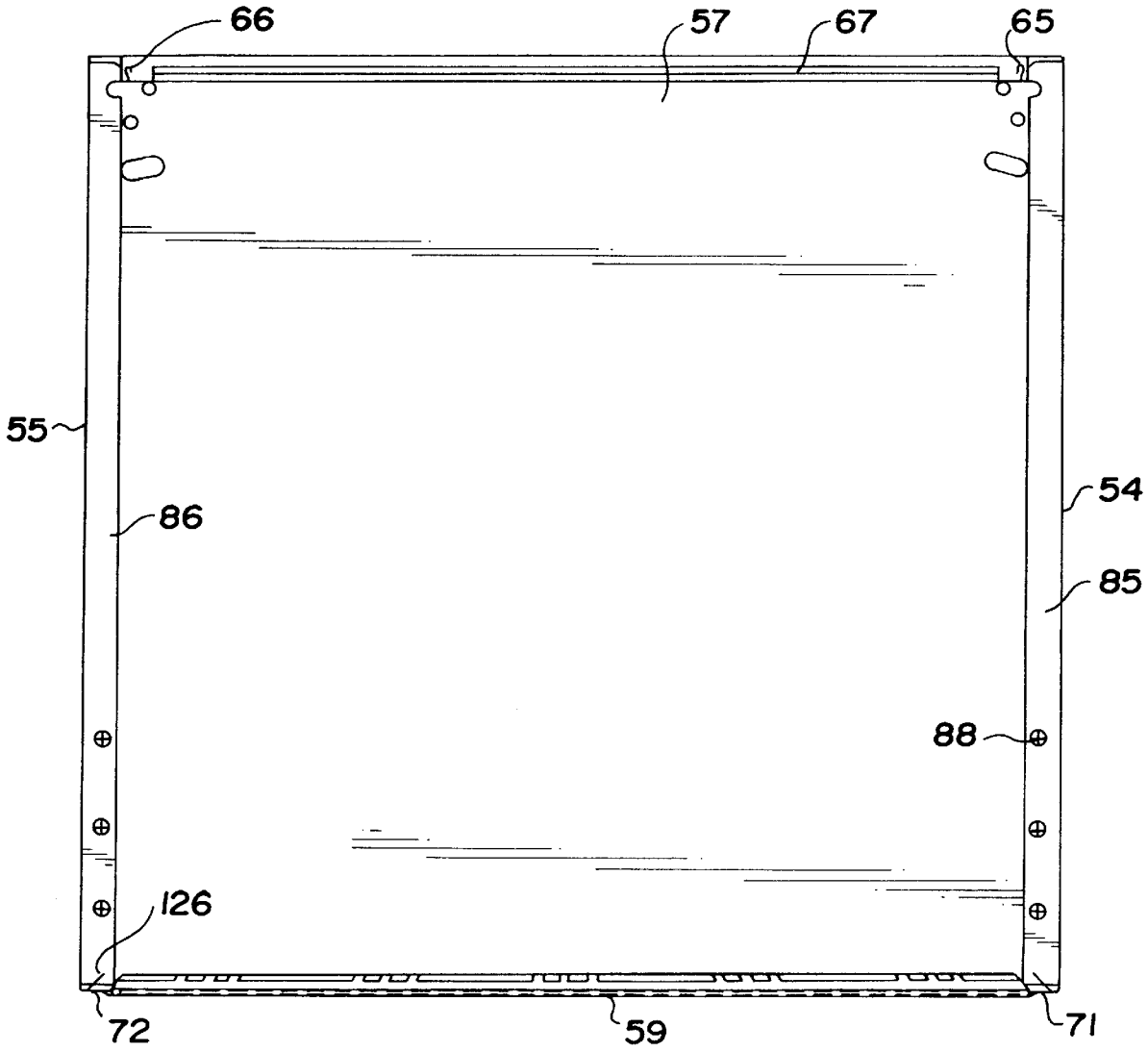
FIG. 5 is a bottom view of the cabinet of FIG. 4 with the inclusion of a rear wall.

Initial reference will be made to FIGS. 4 and 5 in describing the invention. These figures depict a cabinet shell generally indicated at 52 that includes a first side wall 54, a second side wall 55, a top wall 57 and a rear wall 59. As shown in the drawings, side walls 54 and 55 and top wall 57 are integrally formed from bending a piece of sheet metal such that side walls 54 and 55 are arranged in an upstanding, substantially parallel manner and are spaced and interconnected by integral top wall 57. As will be more fully discussed below, rear wall 59 is also preferably formed from sheet metal and is separately secured to side walls 54 and 55, as well as top wall 57.

Front edge portions (not labeled) of each of the side walls 54 and 55 and top wall 57 are bent inwardly so as to define respective front face portions 61–63. Each of the front face portions 61–63 terminate in respective return flanges 65–67. Although the specific structure of return flanges 65–67 will be more fully detailed below, as best shown in FIG. 4, return flanges 65 and 66 include notched-out sections 68 and 69 above midsections thereof. As will be explained hereinafter, these notched-out sections 68 and 69 are utilized in combination with additional structure to subdivide cabinet shell 52 into upper and lower portions so as to define separate refrigerator and freezer sections. As best shown in FIG. 5, rear edge portions (not labeled) of side walls 54 and 55 are also bent laterally inwardly so as to define rear face portions 71 and 72. Although not shown in the drawings, top wall 57 is likewise bent.

With this construction, cabinet shell 52 defines upper corners 74 and 75 at the junction between a respective side wall 54, 55 and top wall 57. Each upper corner 74 and 75 defines a slot 76, 77 at front face portions 61–63. For the sake of completeness, these figures also depict the presence of holes 80–82 which are used to aid in securing hinges to cabinet shell 52 in a manner in which will be more fully discussed below. In addition, FIG. 5 illustrates that the lower ends of side walls 54 and 55 are also bent laterally inwardly so as to define bottom face portions 85 and 86 which are also provided with various holes 88. Holes 88 are actually utilized in attaching a compressor mounting pan to cabinet shell 52 and since this does not constitute an inventive aspect of the present invention, it will not be further discussed herein in detail.

Figure 6:
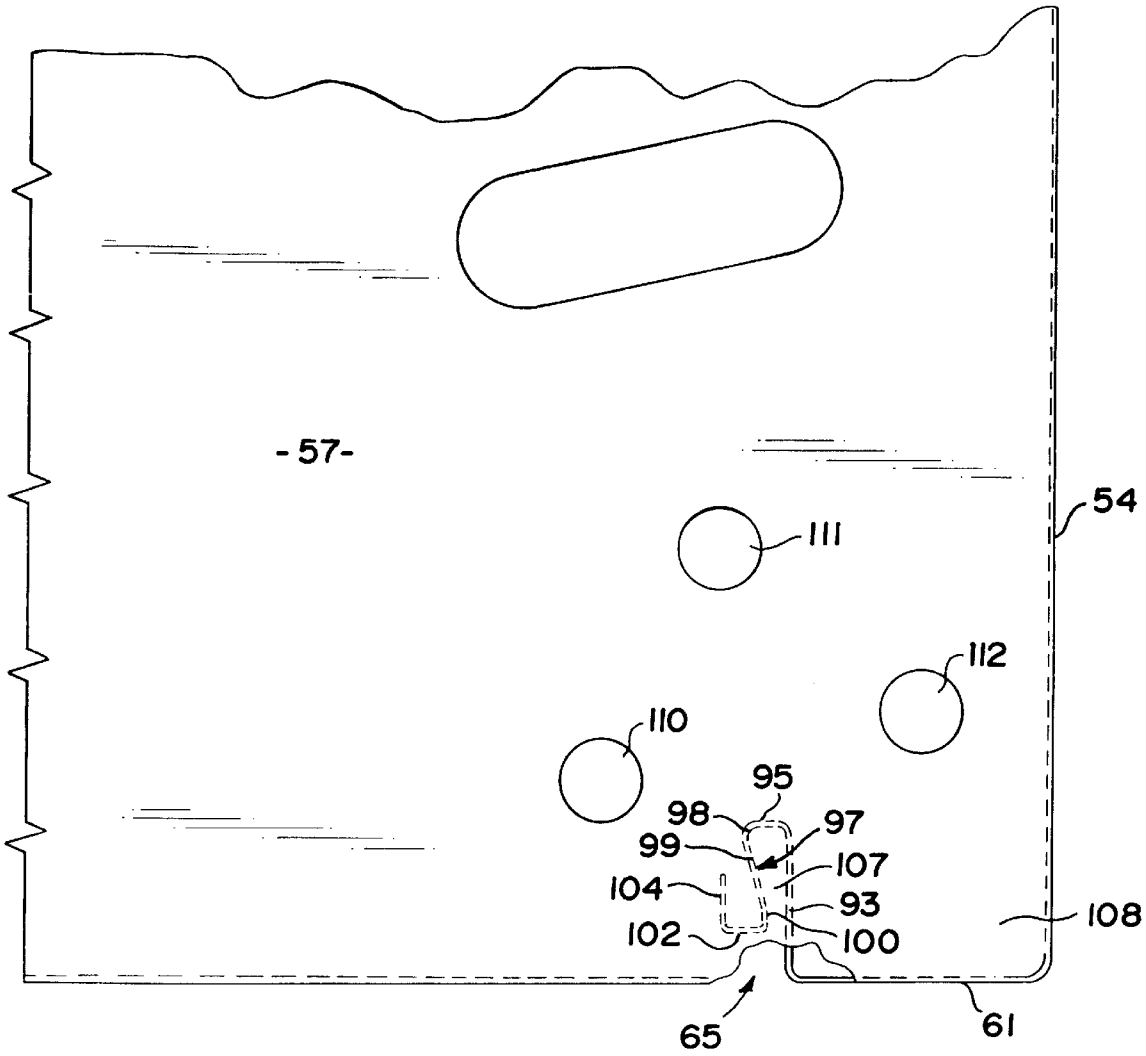
FIG. 6 is a top view of an upper corner of the refrigerator cabinet.

Reference will now also be made to FIG. 6 in describing the specific structure of return flanges 65–67. Since the structure of each return flange 65–67 is identical, a detailed description of return flange 65 will be made and it is to be understood that return flanges 66 and 67 have commensurate structure.

Return flange 65 includes a first section 93 that in the preferred embodiment is formed as a rearwardly extending bent portion of front face portion 61 and which is arranged generally parallel to side wall 54. First section 93 leads to a second section 95 that extends generally laterally inwardly toward second side wall 55. A third section of return flange 65 is generally indicated at 97 and includes a curved portion 98 leading from second section 95, an angled portion 99 which is directed towards first section 93 and a generally straight portion 100 that extends substantially parallel to both first section 93 and side wall 54. In addition, return flange 65 includes a forwardmost fourth section 102 that is arranged substantially parallel to front face portion 61 but which is recessed inside cabinet shell 52 relative to front face portion 61. As shown, fourth section 102 defines an elongated flat surface. Finally, return flange 65 includes a fifth section 104 that again extends rearwardly into cabinet shell 52, generally parallel to first section 93.

Although the enhanced characteristics of return flanges 65–67 based on their configuration will be discussed more fully below, it should be recognized at this point that each return flange 65–67 defines a section of a liner receiving cavity such as that illustrated at 107 in FIG. 6 for return flange 65 and that this liner receiving cavity 107 opens forwardly of cabinet shell 52. In addition, the liner receiving cavity 107 is spaced from side wall 54 by a channel 108 that can be readily accessed from under the return flanges 65–67. Finally with reference to FIG. 6, top wall 57 is provided with a plurality of holes 110–112 which are utilized in securing a tapping plate (not shown) for use in mounting an uppermost door hinge to cabinet shell 52 in a manner known in the art.

Figure 7:
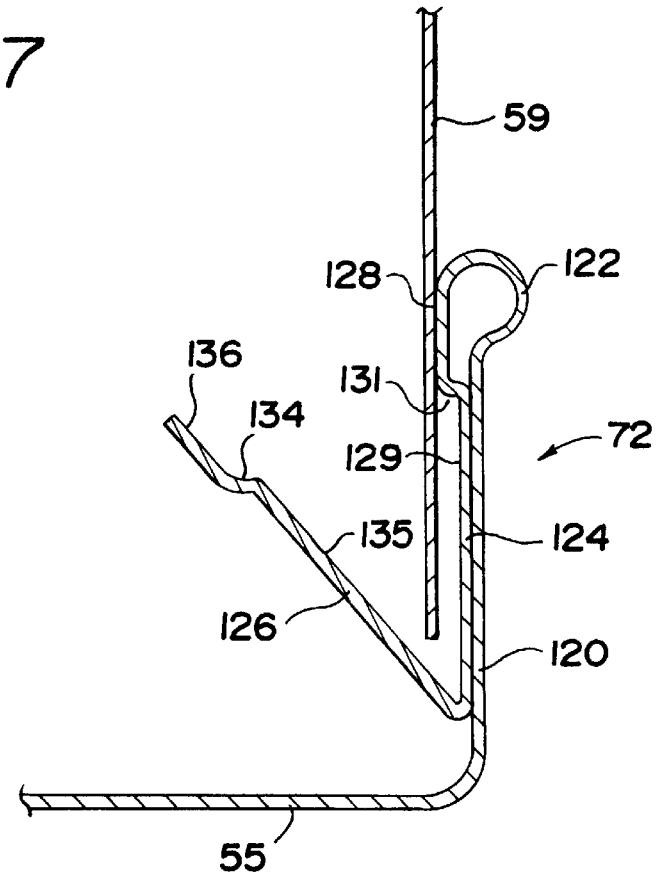
FIG. 7 is a partial cross-sectional view illustrating the pre-attached relationship between the rear wall and a side wall of the cabinet.
Figure 8:
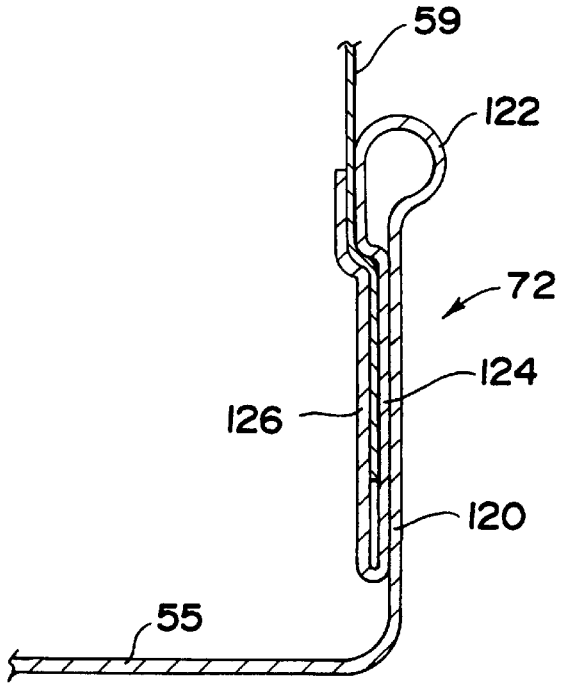
FIG. 8 is a partial cross-sectional view similar to that of FIG. 7 but illustrating a post-attached relationship between the rear and side walls.

Reference now will be made to FIGS. 7 and 8 in describing the particular manner in which rear wall 59 is secured to side walls 54 and 55, as well as top wall 57. Again, since the manner in which rear wall 59 is secured to side walls 54 and 55 and top wall 57 is identical, reference will only be made to the specific manner in which rear wall 59 is secured to side wall 55 and it is to be understood that similar structure is provided at the other connection locations.

Rear face portion 72 includes a first layer 120 that extends laterally from side wall 55 until it reaches a looped section 122. From looped section 122, rear face portion 72 extends laterally outwardly and defines a second layer 124. Second layer 124 terminates shy of sidewall 55, within cabinet shell 52, and is bent to form a third layer 126. Prior to assembly of rear wall 59 to the remainder of cabinet shell 52, second layer 124 and third layer 126 are generally V-shaped in cross-section as best shown in FIG. 7. Actually, second layer 124 includes a first section 128 and a second section 129 that are interconnected by an offsetting section 131. In a similar manner, the third layer 126 includes an offsetting section 134 that interconnects a first section 135 and a second section 136 thereof.

With this construction, when rear wall 59 is positioned between second and third layers 124 and 126, third layer 126 can be shifted from the position shown in FIG. 7 to that shown in FIG. 8 in order to retain rear wall 59 between and in intimate contact with second and third layers 124 and 126. In the preferred embodiment, third layer 126 is crimped to assume the position shown in FIG. 8. During this operation, rear wall 59 is deformed so as to follow the contours of the various sections of second and third layers 124 and 126. Particularly at offsetting sections 131 and 134, rear wall 59 is pinched such that rear wall 59 is essentially sealed to rear face portion 72. This arrangement has been found to be particularly advantageous in providing an extremely cost effective and time efficient assembly method between rear wall 59 and the remainder of cabinet shell 52, as well as preventing any undesirable outflow of insulating foam injected between cabinet shell 52 and liners placed therein as will be discussed more fully below.

As mentioned above, forming a refrigerator cabinet shell of thin sheet metal or similar generally flexible material requires that the cabinet be reinforced to adequately withstand loads exerted thereon during normal use. Reference will now be made to FIGS. 9–12 in describing a first preferred reinforcement arrangement adapted to be incorporated in rather large, heavy duty refrigerator (i.e. refrigerators with capacities of approximately 20 cubic feet or greater) in accordance with the present invention.

Figure 9:
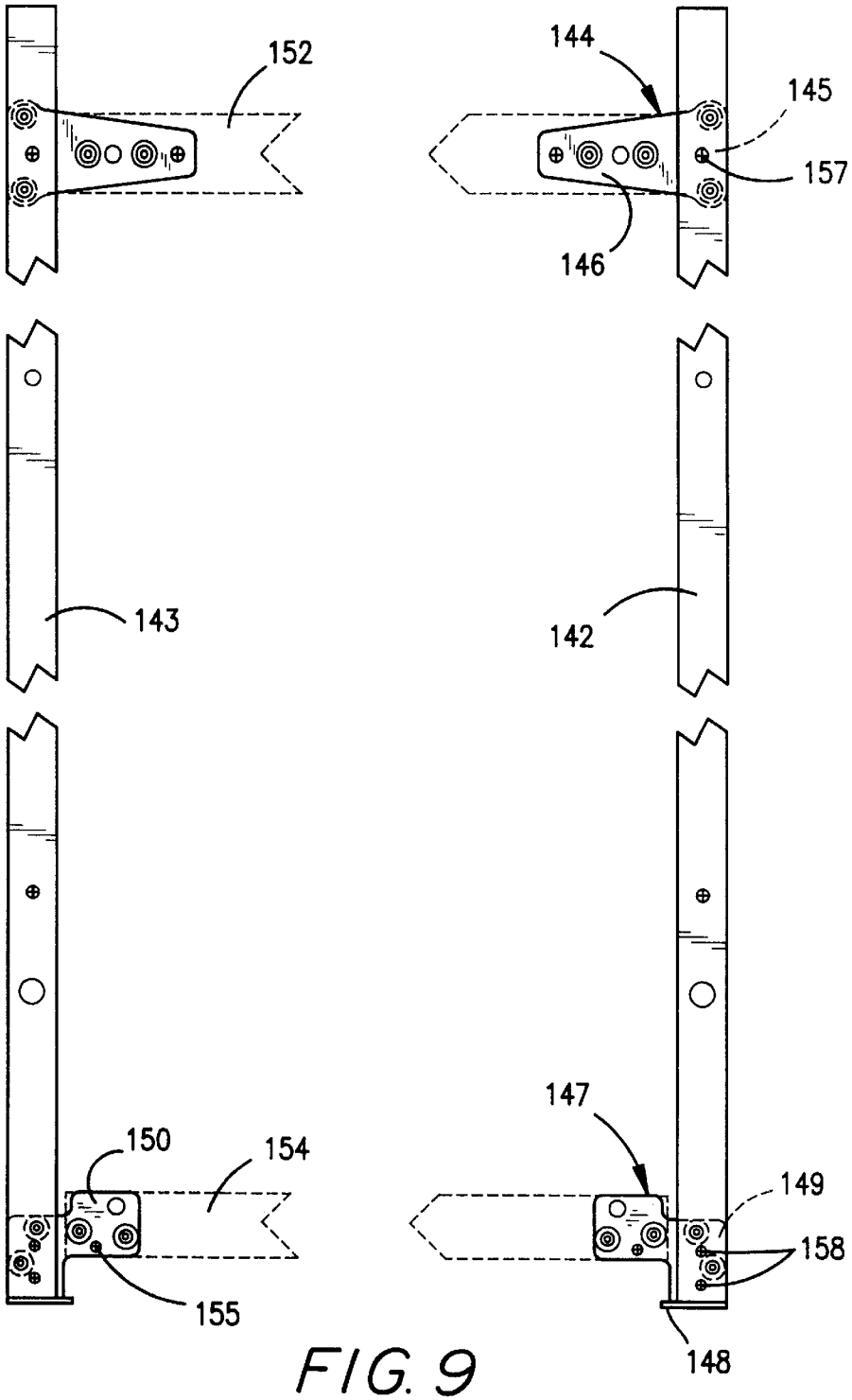
FIG. 9 is a front view of a reinforcement assembly adapted to be incorporated in the refrigerator cabinet in accordance with a first embodiment of the invention.
Figure 10:
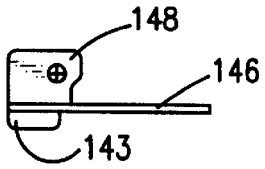
FIG. 10 is a top view of one side portion of the reinforcement assembly of FIG. 9.

With initial reference to FIGS. 9 and 10, this reinforcement arrangement includes a pair of side reinforcement members 142 and 143 that are generally in the form of elongated, solid rectangular bars. Secured to each side reinforcing member 142, 143, adjacent a top end thereof, is an upper support bracket 144 having a first portion 145 which is welded, preferably at vertically spaced projection weld locations as indicated in FIG. 9 but not separately labeled, or otherwise fixedly secured to a respective side reinforcement member 142, 143 and a second portion 146 which projects laterally inwardly. At a lower portion of each side reinforcement member 142, 143 is a lower support bracket 147 that is also welded or otherwise secured in place. Each lower support bracket 147 includes a rearwardly extending portion 148, an upwardly extending portion 149 that is fixedly secured to the respective side reinforcement member 142, 143 and a laterally inwardly extending portion 150.

Interconnected between second portions 146 of upper support brackets 144 is a first crossbar 152. In a similar manner, fixedly secured between laterally inwardly extending portions 150 of lower support brackets 147 is a second crossbar 154. First and second crossbars 152 and 154 are shown in dotted lines in FIG. 9 since, in the preferred assembly method, first and second crossbars 152 and 154 would not be attached to upper and lower support brackets 144 and 147 respectively until side reinforcement members 142 and 143 are positioned within cabinet shell 52. In the embodiment depicted, second crossbar 154 is provided with mounting holes 155 for use in mounting a lower refrigerator door hinge (not shown). Although the specific manner in which side reinforcement members 142 and 143, upper support brackets 144, lower support brackets 147 and first and second crossbars 152 and 154 are attached to cabinet shell 52 will be more fully detailed below, at this point it should be recognized that, in accordance with the present invention, upper and lower hinge mounting holes 157 and 158 are provided in this reinforcing arrangement and these holes are utilized, with holes 155 and holes (not labeled) provided at the inner ends of second portions 146, in mounting upper and lower hinges for a lower door, as well as a lower hinge for an upper door of the refrigerator. Although holes are described for this hinge mounting arrangement, other structural elements could be incorporated and equally utilized. In the preferred embodiment, holes 157 and 158 are drilled through respective side reinforcing members 142 and 143, as well as brackets 144 and 147, after brackets 144 and 147 have been projection welded or otherwise secured to the side reinforcing members 142 and 143. In addition, clearance holes (not shown) are formed in the first and second crossbars 152 and 154 to align behind the hinge mounting holes in the upper and lower support brackets 144 and 147.

Figure 11:
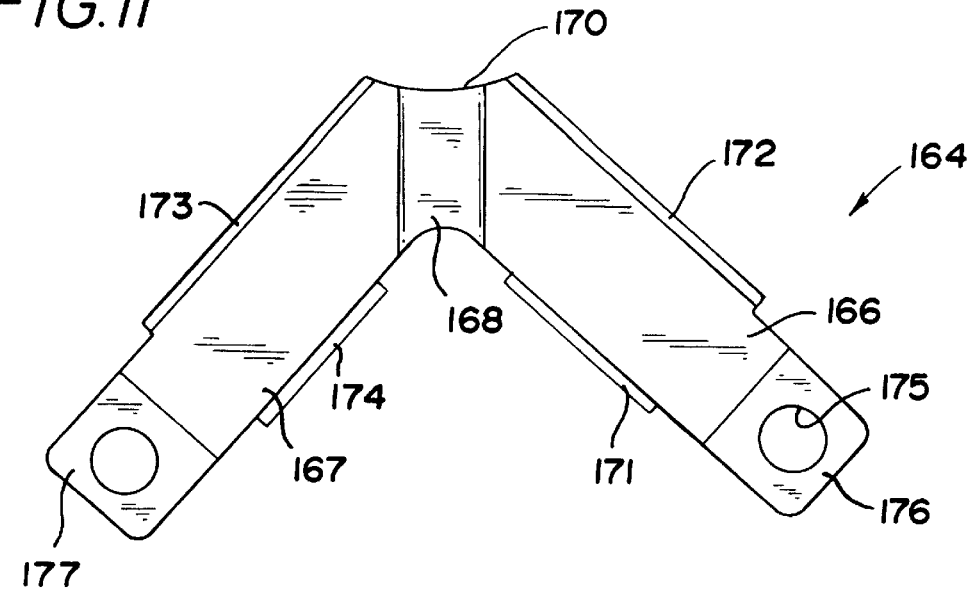
FIG. 11 is a top plan view of an upper corner plate that forms part of the overall reinforcement assembly for the cabinet in accordance with the invention.
Figure 12:
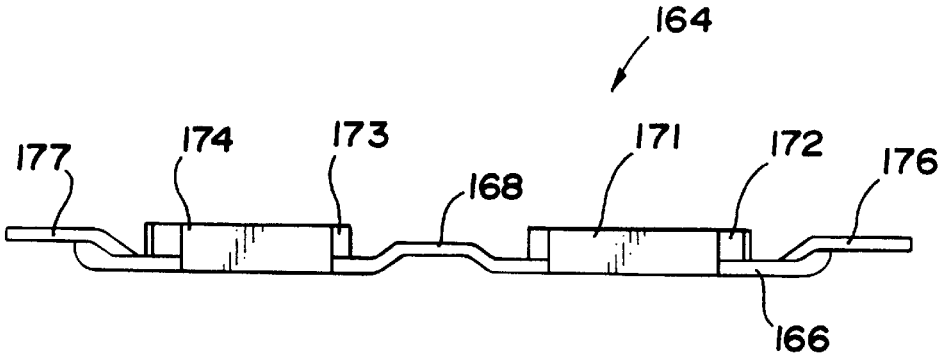
FIG. 12 is a front elevational view of the upper corner plate of FIG. 11.

Reference will now be made to FIGS. 11, 12 and **12*a* in describing additional elements of the overall reinforcing arrangement for cabinet shell 52. These figures depict an upper corner plate generally indicated at 164. A separate upper corner plate 164 is adapted to be positioned against the respective front face portion 61–63 in each upper corner 74 and 75 of cabinet shell 52 as will be fully described hereinafter. As shown in these figures, each upper corner plate 164 is provided with a first leg portion 166 and a second leg portion 167 which are interconnected by a central portion 168. At central portion 168, which is raised relative to a plane defined by first and second leg portions 166** and 167 to increase the bending resistance of upper corner plate 164 and to provide clearance for corner covers (not shown), is an arcuate cut-out section 170. In addition, each upper corner plate 164 includes upstanding wall sections 171–174 extending along predetermined lengths of first and second leg portions 166 and 167. Finally, upper corner plates 164 are provided with holes 175 in offset terminal end portions 176 and 177 of first and second leg portions 166 and 167.

Figure 12A:
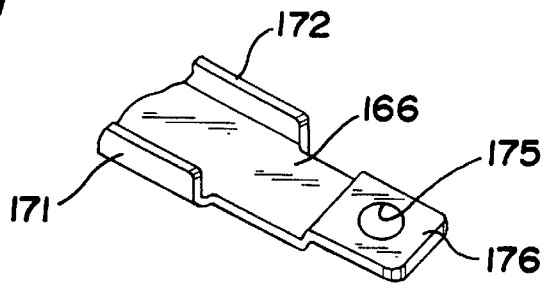
FIG. 12*a* is a perspective view of an end of the upper corner plate of FIG. 11.
Figure 13:
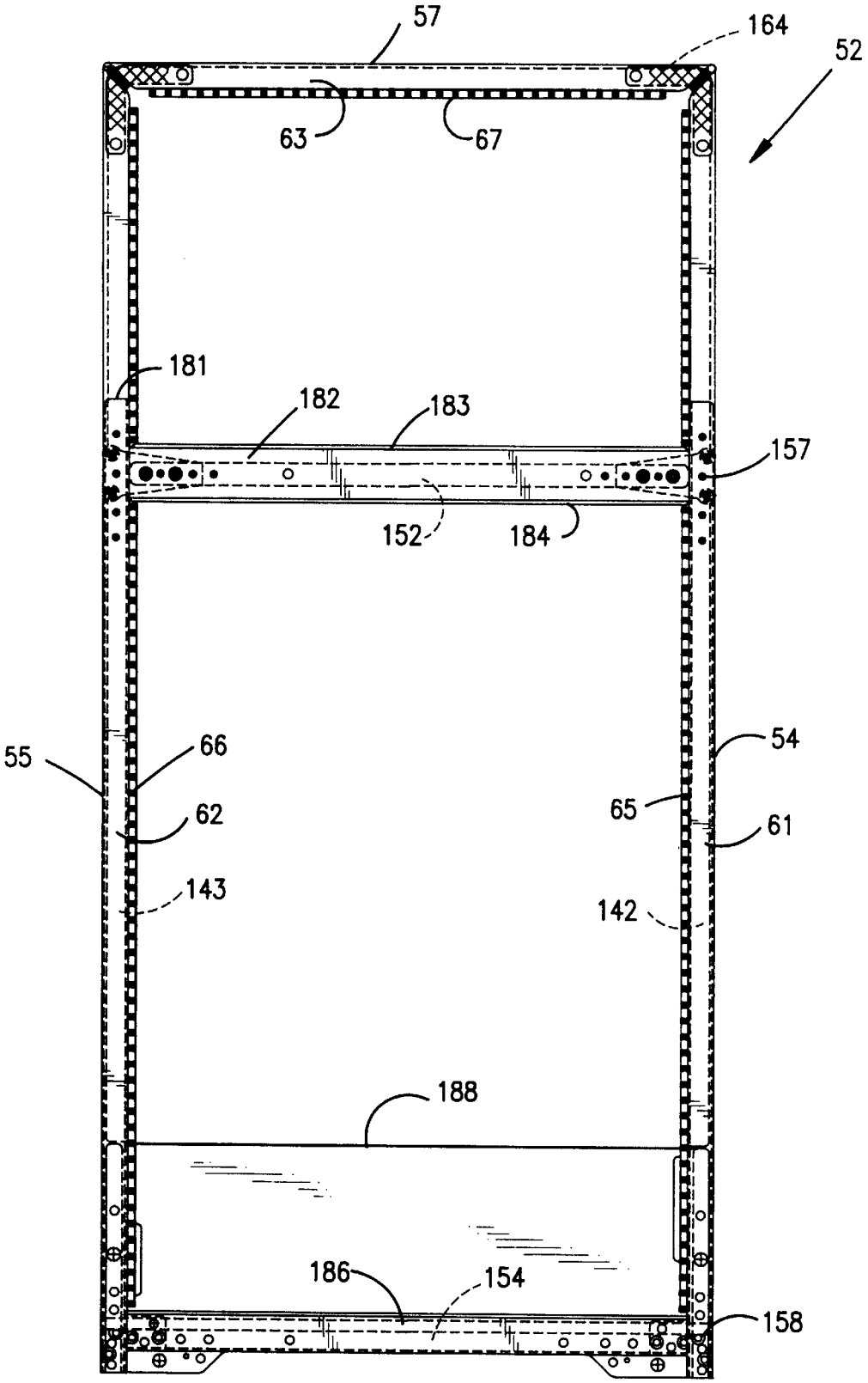
FIG. 13 is a front view of the shell, similar to that of FIG. 4, but with the reinforcement assembly according to the embodiment of FIGS. 9–12 in place.

Reference will now be made to FIG. 13 in describing the manner in which the reinforcement members described in the embodiment of FIGS. 9 and 10 and the reinforcement members illustrated in FIGS. 11, 12 and 12*a* are incorporated into cabinet shell 52 and are used to reinforce the same. Again, this reinforcement structure is important since enhanced efficiency of the final refrigerator product is dependent upon a good sealing connection between the doors of the refrigerator and the peripheral face portions of cabinet shell 52 and good sealing contact requires a cabinet assembly that assumes a predetermined shape and retains that shape, along with the proper alignment of particular parts.

With this in mind, the pair of upper corner plates 164 are positioned within channel 108 and secured to front face portions 61–63 in order to maintain a desired angular relationship between side walls 54 and 55 and top wall 57. In the preferred embodiment, first and second leg portions 166 and 167 of each upper corner plate 164 are arranged at right angles to each other such that a commensurate angle is formed between each side wall 54, 55 and top wall 57. Although the specific manner in which upper cover plates 164 are secured within channels 108 could readily vary, in the preferred embodiment upper corner plates 164 are adhesively secured in place with induction curing to create a rigid attachment. The offset of terminal end portions 176 and 177 assists in locating the upper corner plates 164 during the assembly process and enables the corner plates 164 to be held in place while the adhesive cures. Holes 175 accommodate a pin during the assembly process to aid in the alignment. With the inclusion of flanges 171–174, the adhesive cannot slide over the surface of the corner plate 164 and flanges 171 and 174 particularly prevent the adhesive from getting into an induction coil used for the curing process. Of course, since return flanges 65–67 are spaced from respective side walls 54, 55 and top wall 57, channel 108 can be readily accessed to position upper corner plates 164 therein by simply arranging the upper corner plates 164 below return flanges 65–67 and coming in from the rear of channel 108.

Although the reinforcement arrangement depicted in FIGS. 9 and 10 could be pre-assembled and inserted within cabinet shell 52 as a unit, as indicated above, upper and lower support brackets 144 and 147 are preferably pre-attached to side reinforcement members 142 and 143, such as by welding, without first and second crossbars 152 and 154. These sub-assemblies are riveted within respective portions of channel 108 near holes 80–82 along respective front face portions 61 and 62. Of course, each second portion 146 of a corresponding upper support bracket 144 will project into a respective notched-out section 68, 69 in return flanges 65 and 66 and laterally inwardly extending portion 150 of each lower support bracket 147 will be arranged below a respective return flange 65,66 since these return flanges terminate prior to the bottom of side walls 54 and 55 as best shown in FIG. 4. Although not shown in the drawings, it is preferable to provide front face portions 61 and 62 with hinge mounting holes corresponding to holes 157 and 158 to assure proper alignment and positioning of side reinforcing members 142 and 143 in channel 108. After side reinforcing members 142 and 143 are secured within channel 108 at their respective positions, first and second crossbars 152 and 154 are preferably welded in position. As best shown in FIG. 13, side reinforcement members 142 and 143 include terminal upper ends 181 which extend only slightly above crossbar 152. Over crossbar 152 is then positioned a mullion bar 182 which itself defines upper and lower return flanges 183 and 184 that are constructed similar to return flanges 65–67 except that return flanges 183 and 184 are preferably bent outwardly to define a larger liner receiving cavity. Further attached to second crossbar 154 is a faceplate 186 which has a return flange substantially identical to that of the mullion bar 182. Also shown in FIG. 13 is a sloping portion 188 of a bottom plate located within cabinet shell 52. As is known in the art, behind sloping portion 188 is provided a chamber within which is mounted a compressor, condenser, fan and other structure (all not shown) conventionally incorporated as part of a refrigeration circuit.

In a manner similar to upper corner plates 164, it should be readily apparent that side reinforcing members 142 and 143 can be readily inserted within channel 108 from behind and this insertion is not obstructed by return flanges 65 and 66. This is due to the manner in which return flanges 65 and 66 are spaced from the respective side walls 54 and 55. Therefore, the entire reinforcing arrangement can be easily positioned and incorporated in cabinet shell 52 to structurally reinforce the same. In addition, at least one of the selected side reinforcement members 142 and 143 aids in defining the location of three out of the five hinge points provided for the overall refrigerator cabinet. For example, if a left side hinge is desired in the cabinet design shown, side reinforcing member 143 will aid in defining the location for a lower hinge of the refrigerator door, an upper hinge for the refrigerator door and a lower hinge on the freezer door. Since a single reinforcement member is utilized as side reinforcement member 143, these three hinge mounting locations can be precisely aligned in a highly advantageous manner. Although side reinforcing members 142 and 143 do not extend within channel 108 into the upper front face portions of cabinet shell 52 in the preferred embodiment shown, it should be recognized that side reinforcing members 142 and 143 could be extended upwardly if desired and could also be formed integral with the upper corner plates 164. However, given weight distribution factors generally associated with cabinet shell 52, it is not necessary to extend side reinforcing members 142 and 143 in this manner and therefore a material cost savings can be achieved.

Figure 14:
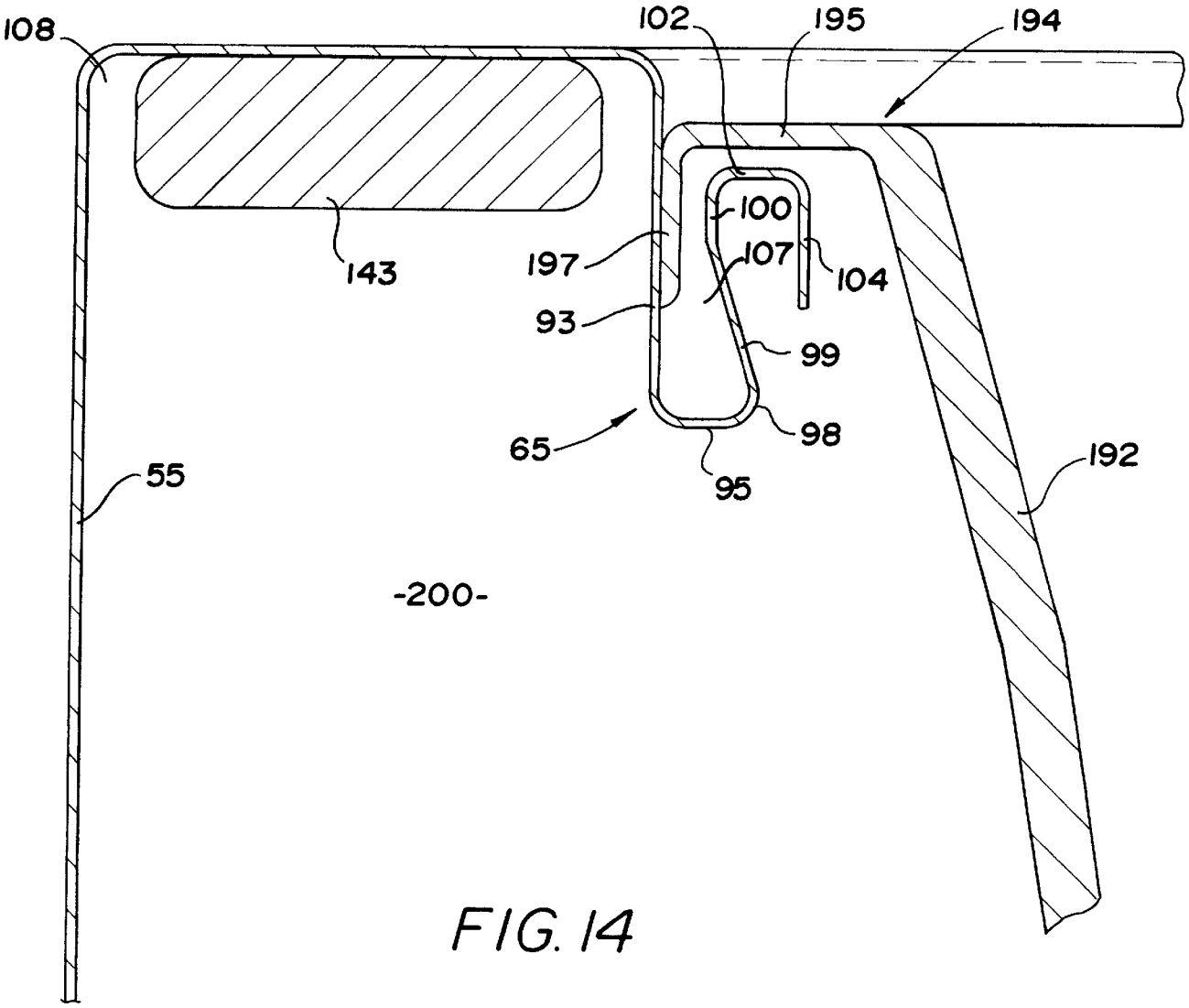
FIG. 14 is a partial cross-sectional view of a front corner of the refrigerator cabinet of FIG. 13 but with a liner installed, generally illustrating a interconnection between the shell and the liner.
Figure 15:
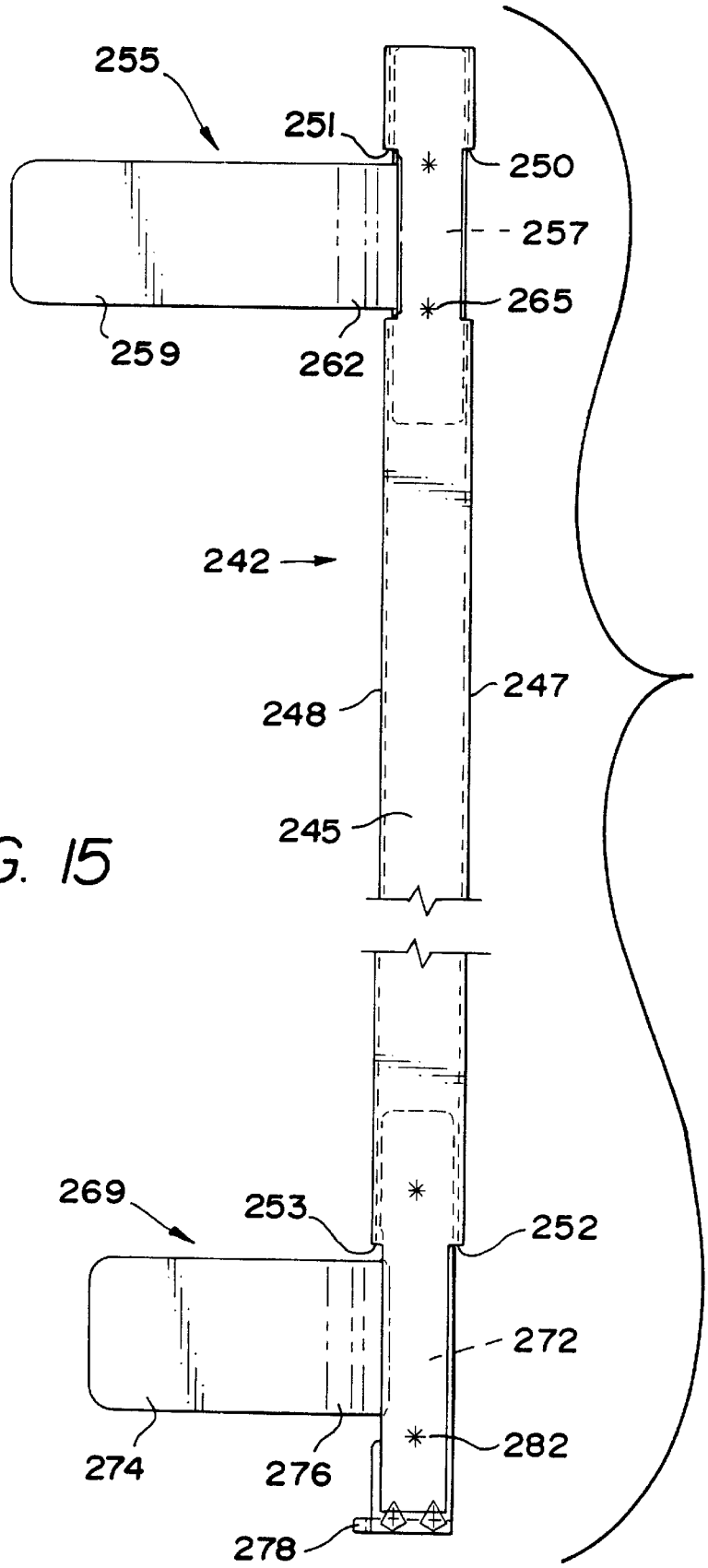
FIG. 15 is an exploded front view of a right-side portion of a reinforcement assembly adapted to be incorporated in the refrigerator cabinet in accordance with a second embodiment of the invention.

Not only does the configuration of return flanges 65–67 enhance the ability of the various reinforcement members to be inserted in channel 108 as discussed above, it also enables upper and lower cabinet liners, one of which is partially indicated at 192 in FIG. 14, to be easily front-loaded within cabinet shell 52. As generally represented in this figure, liner 192 is formed with an annular rim 194 that includes an out-turned portion 195 and an inwardly extending flange portion 197. When liner 192 is inserted within, for example, a lower section of cabinet shell 52 as illustrated in FIG. 13 to define a refrigerator section, liner 192 can be simply slid into the provided space with flange 197 deflecting within receiving cavity 107 of return flanges 65 and 66, as well as the receiving cavity of lower return flange 184 defined by mullion bar 182, due to the engagement of flange 197 with first section 93. In FIG. 14, the insertion of liner 192 has been completed, at which point it should be noted that out-turned portion 195 is spaced from and substantially parallel to planes defined by both fourth section 102 of return flange 65 and face portion 61 as shown. After liner 192 is inserted, an insulation zone 200 is preferably spray filled with foam insulation. Due to the spacing of horizontal portion 195 and fourth section 102, the insulation can advantageously fill the return flange cavity 107 to retain flange 197 in engagement with first section 93. The abutment of flange 197 with first section 93 prevents insulation from flowing between these two elements and therefore assures an aesthetic front view of the overall cabinet assembly. Prior to inserting a similar liner within the upper freezer section defined by cabinet shell 52, corner covers are preferably inserted within slots 76 and 77 to seal these areas while providing an aesthetically pleasing look for cabinet shell 52, then the liner is inserted and a similar foaming operation occurs.

For use in smaller refrigerators such as those under 20 cubic feet in size, a lighter reinforcement assembly is preferably utilized. Reference will now be made to FIGS. 15–20 in describing this second reinforcement assembly embodiment. Throughout the description, it should be realized that corresponding reference numerals to the embodiment described above have been brought forward and refer to corresponding parts. Therefore, these reference elements will not be described again here. For instance, the structure shown in FIGS. 4–8, as well as the upper corner plate structure shown at 164 in FIGS. 11 and 12 are identical for both embodiments and therefore a redescription thereof is not provided here.

Figure 16:
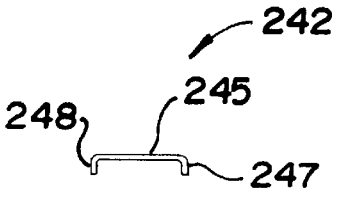
FIG. 16 is a cross-sectional view of a reinforcement bar incorporated in the reinforcement assembly of FIG. 15.
Figure 17:
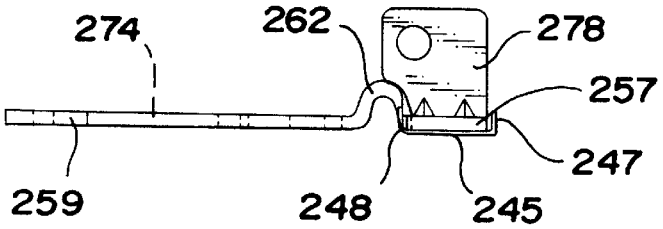
FIG. 17 is a top view of the reinforcement assembly of FIG. 15.
Figure 18:
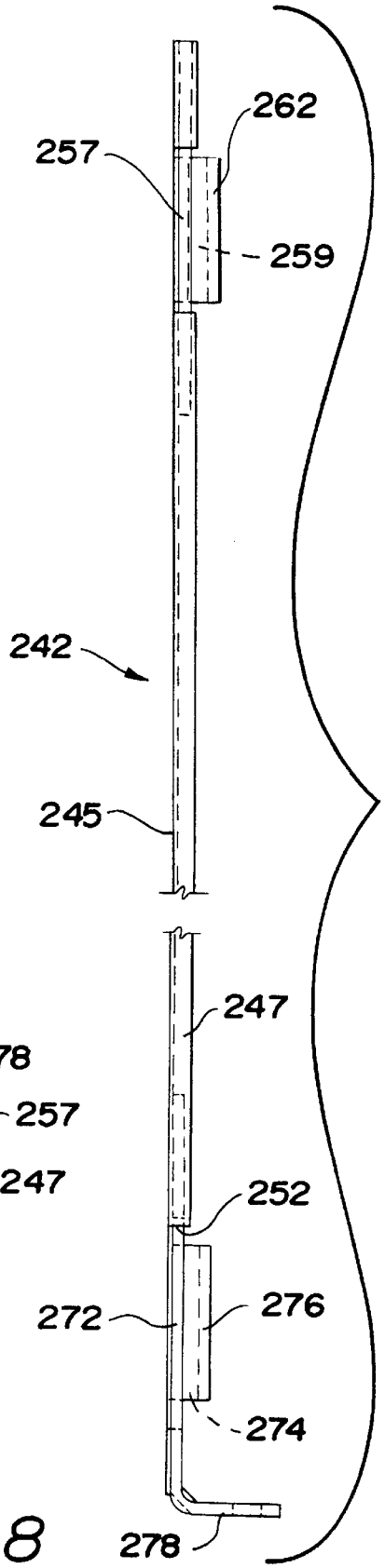
FIG. 18 is a side view of the reinforcement assembly of FIG. 15.
Figure 19:
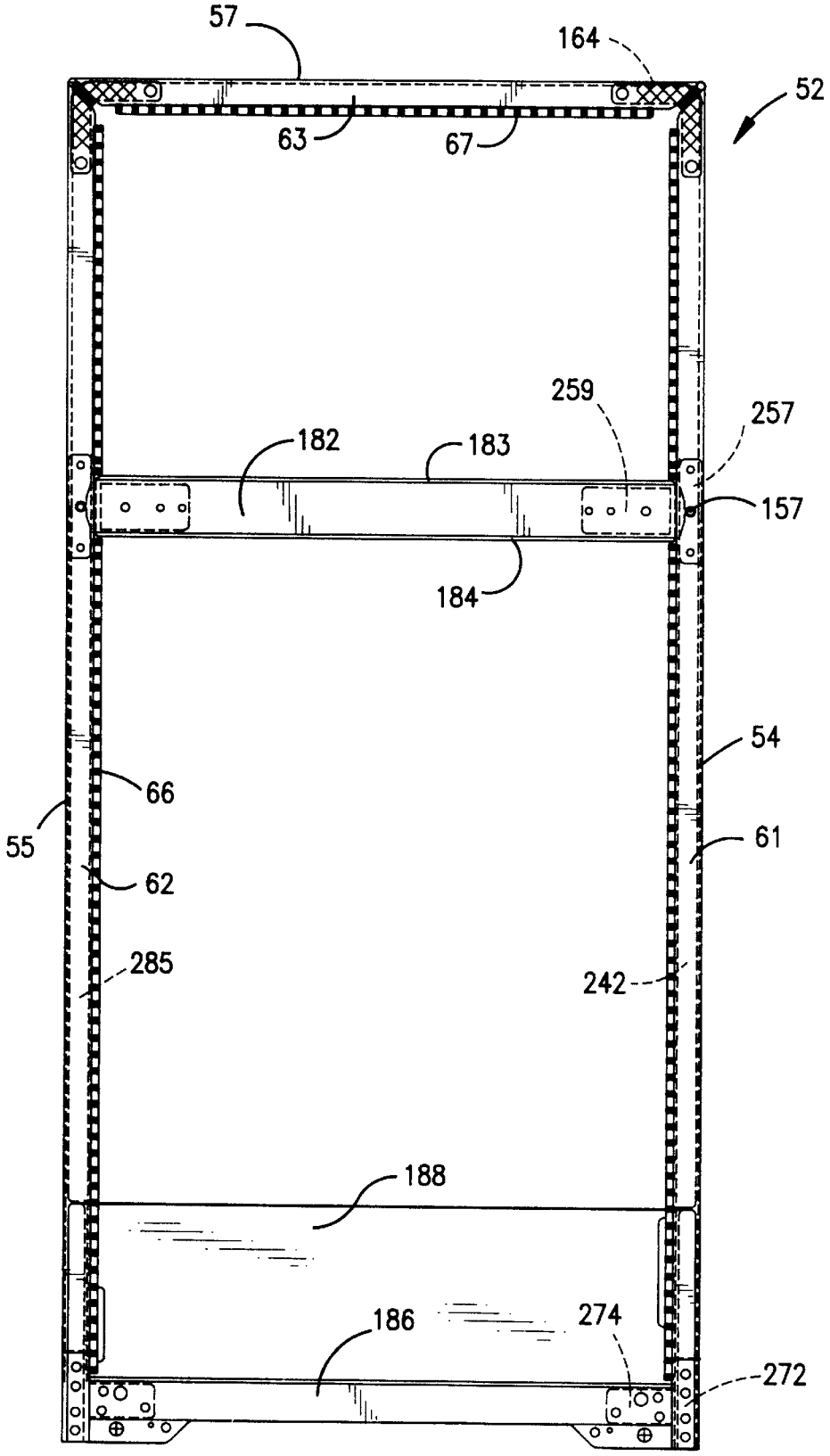
FIG. 19 is a front view of the shell, similar to that of FIG. 4, but with the reinforcement assembly according to the embodiment of FIGS. 15–18 in place.
Figure 20:
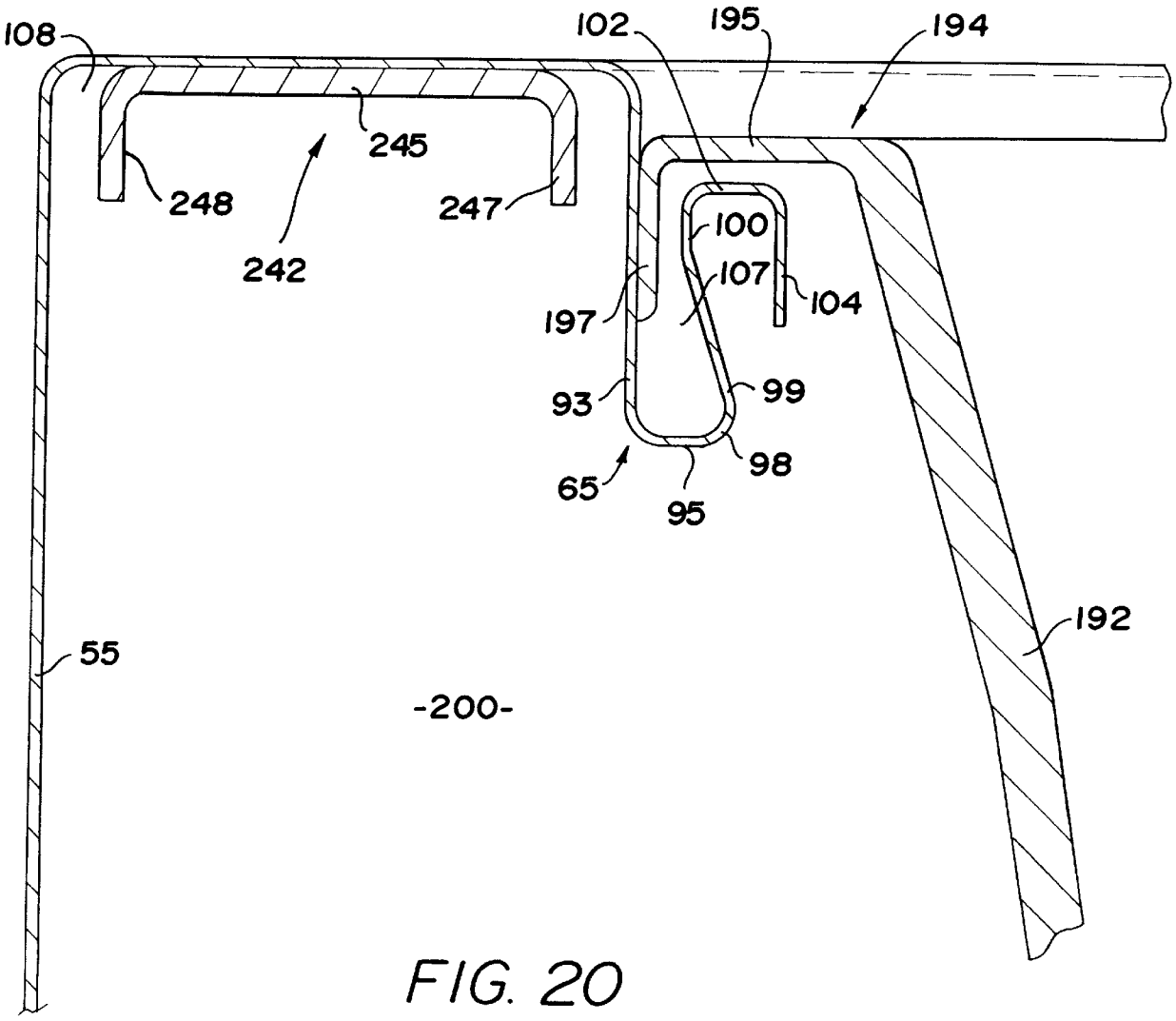
FIG. 20 is a partial cross-sectional view of a front corner of the refrigerator cabinet similar to that shown in FIG. 14 but incorporating the reinforcement assembly according to the embodiment of FIGS. 15–18.

Since this reinforcement assembly embodiment is utilized in smaller refrigerators where extra horizontal stability is not generally required, a lighter side reinforcement member is incorporated in place of reinforcement members 142 and 143 which took the form of solid rectangular bars. According to this embodiment, a pair of side reinforcement members are provided with one being generally indicated at 242. In this embodiment, side reinforcing member 242 takes the form of a channel bar this is generally U-shaped in cross-section as best shown in FIGS. 16 and 20. Since the left and right side reinforcement members are substantial mirror images of each other, only right-side reinforcement member 242, which constitutes a reinforcing support adapted to be positioned behind front face portion 61, will be described in detail. Side reinforcement member 242 includes a front portion 245 and two side portions 247 and 248 which project substantially perpendicular from front portion 245. Side reinforcement member 242 includes a pair of opposed upper side notched-out sections 250 and 251, as well as a pair of lower side notched-out sections 252 and 253.

This reinforcement assembly embodiment also includes an upper support bracket 255 having a first portion 257 that is positioned within the channel (not separately labeled) defined by U-shaped side reinforcement member 242. Upper support bracket 255 further includes a second portion 259 that is interconnected with the first portion 257 through a curved portion 262 (particularly see FIGS. 15 and 17). Curved portion 262 projects through upper side cut-out section 251 and second portion 259 extends substantially parallel to front portion 245 of side reinforcement member 242. Upper support bracket 255 is welded within the U-shaped channel of side reinforcement member 242 at weld locations indicated at 265.

A lower support bracket 269 is provided which includes a first portion 272 and a second portion 274 that are interconnected by a curved portion 276. Furthermore, lower support bracket 269 includes a bottom L-shaped portion 278 which is generally analogous to rearwardly extending portion 148 of lower support bracket 147 described with respect to the first preferred embodiment. Lower support bracket 269 is secured, preferably by welding at locations 282, within the U-shaped channel defined by side reinforcement member 242 with curved portion 276 extending out through lower side cut-out section 253 and with second portion 274 extending generally parallel to front portion 245. Side reinforcement member 242 is provided with upper side notched-out section 250 and lower side notched-out section 252 such that a single type of side reinforcing member 242 can be produced and used as a reinforcement member on both sides of cabinet shell 52.

In accordance with this embodiment, the right-side reinforcement member 242 and a corresponding left-side reinforcement member 285 (shown in FIG. 19) are adapted to be positioned within channels 108 in a manner directly analogous to side reinforcement members 142 and 143. However, in accordance with this embodiment, no structure corresponding to first and second crossbars 152 and 154 are provided but rather mullion plate 182 interconnects the upper support brackets 255 and faceplate 186 interconnects the lower support brackets 269. Since no analogous crossbars are utilized in this embodiment, preferably second portions 259 and 274 provide an enlarged surface area for securably attaching mullion plate 182 and faceplate 186 respectively thereto as clearly shown in FIG. 19. In essentially all other respects, the second reinforcement assembly embodiment shown in FIGS. 15–20 is identical to that described above. Although certain structure may be omitted in these figures for clarity such as corresponding hinge mounting holes 157 and 158 not being shown in FIG. 15, the provision of these holes is a particular aspect of the invention and incorporated in both embodiments as represented by the inclusion of hole 157 in FIG. 19. In addition, it should be recognized that side reinforcement member 242 can be readily inserted into channel 108 and liner 194 can be front-loaded into cabinet shell 52 in the manner directly analogous to that described above in detail with respect to the first preferred embodiment of the invention.

From the above description, it should be readily apparent that the reinforced cabinet assembly and method of assembling the same according to the invention has enhanced structural features due to the inclusion of various reinforcement members. In addition, the invention evinces simplified assembly characteristics due to the manner in which the reinforcement members can be easily inserted and secured to the cabinet shell and the manner in which the liners readily cooperate with the return flanges. Finally, the assembly is extremely cost effective and aesthetically pleasing. However, although described with respect to preferred embodiments of the invention, it should be readily understood that various changes and/or modifications may be made to the invention without departing from the spirit thereof. In general, the invention is only intended to be limited by the scope of the following claims.

We claim:

1. A refrigerator cabinet assembly comprising:

a shell including first and second laterally spaced upstanding side walls that are interconnected by a top wall, each of said first and second side walls and said top wall including front edge portions being in-turned to form respective front face portions of said shell, each of said front face portions terminating in a return flange that defines a liner receiving cavity section opening forwardly of said shell and being spaced from said side and top walls by a channel, said channel extending about a periphery of said shell, behind the front face portions of said side and top walls, and unobstructively opening into an interior of said cabinet;

a reinforcement assembly including a plurality of reinforcement members positioned at predetermined locations within said channel between a respective return flange and an inner wall portion of a respective one of said side and top walls; and means for securing said plurality of reinforcement members within said channel.

2. The refrigerator cabinet assembly according to claim 1, wherein said securing means fixedly attaches said plurality of reinforcement members, at said predetermined locations, to the front face portions of said side and top walls.

3. The refrigerator cabinet assembly according to claim 1, wherein said plurality of reinforcement members includes a pair of upper corner plates, each of said upper corner plates including first and second leg portions arranged substantially perpendicular to each other.

4. The refrigerator cabinet assembly according to claim 3, wherein the first and second leg portions of each of said upper corner plates are interconnected by a central portion, said first and second leg portions being generally located in a first plane and said central portion projecting above said first plane.

5. The refrigerator cabinet assembly according to claim 3, wherein the first and second leg portions of each of said upper corner plates are generally located in a first plane and have projecting substantially perpendicular to said first plane, along edge portions thereof, first and second upstanding wall sections.

6. The refrigerator cabinet assembly according to claim 1, wherein said plurality of reinforcement members includes first and second side reinforcement bars respectively arranged in said channel behind the front face portions of said first and second side walls and laterally outwardly of a respective said return flange.

7. The refrigerator cabinet assembly according to claim 6, wherein each of said first and second side reinforcement bars are defined by channels that are generally U-shaped in cross-section.

8. The refrigerator cabinet assembly according to claim 6, wherein said plurality of reinforcement members further includes first and second sets of support brackets each one of said first and second side reinforcement bars including a lower end portion having secured thereto one of the support brackets of said first set and an upper end portion having secured thereto one of the support brackets of said second set.

9. The refrigerator cabinet assembly according to claim 8, wherein the return flange associated with each of said side walls is formed with a notched-out section into which projects a respective one of said second set of support brackets.

10. The refrigerator cabinet assembly according to claim 8, further comprising a first crossbar interconnecting said first set of support brackets and a second crossbar interconnecting said second set of support brackets.

11. The refrigerator cabinet assembly according to claim 8, wherein said first and second sets of support brackets include hinge mounting means for attaching and automatically aligning upper and lower first door hinges, as well as a lower second door hinge.

12. The refrigerator cabinet assembly according to claim 6, wherein said shell has an associated height, each one of said reinforcement bars having an associated length which is substantially less than the height of said shell.

13. The refrigerator cabinet assembly according to claim 12, wherein said plurality of reinforcement members includes a pair of upper corner plates, each of said upper corner plates including first and second leg portions arranged substantially perpendicular to each other.

14. The refrigerator cabinet assembly according to claim 1, wherein each of said return flanges includes a first section extending rearwardly from a respective said front face portion, generally parallel to a respective one of said side and top walls, a second section extending away from the respective one of said side and top walls and a third section extending generally forwardly, each of said liner receiving cavity sections being defined between the first and third sections of said return flanges.

15. The refrigerator cabinet assembly according to claim 14, wherein the third section of each of said return flanges is further angled towards the first section thereof.

16. The refrigerator cabinet assembly according to claim 15, wherein each said return flanges further includes a fourth section stemming from said third section and a fifth section, each said fourth section defining an elongated flat section that extends generally parallel to a respective said front face portion, each said fifth section extending from said fourth section generally rearwardly into said cabinet.

17. The refrigerator cabinet assembly according to claim 16, further comprising a liner having an out-turned portion that leads to an inwardly extending flange, said liner being mounted to the shell with the inwardly extending flange projecting into the liner receiving cavity and the out-turned portion spaced from the fourth section of the return flanges.

18. The refrigerator cabinet assembly according to claim 17, wherein the out-turned portion extends in a plane intermediate planes defined by the front face portions of said shell and the fourth section of the return flanges respectively.

19. The refrigerator cabinet assembly according to claim 17, wherein the inwardly extending flange abuts the first section of a respective said return flange.

20. The refrigerator cabinet assembly according to claim 1, wherein said side walls include rear face portions that extend substantially perpendicular to the majority of said sidewalls and which include first, second and third layers, said cabinet assembly further including a rear wall having upstanding end sections located between the second and third layers of the rear face portions of said sidewalls.

21. The refrigerator cabinet assembly according to claim 20, wherein said second and third layers are bent at corresponding locations such that, when said rear wall is positioned therebetween and said second and third layers are brought together, said rear wall is clamped between said second and third layers at the bent locations.

* * * * *